United States Patent [19]

Oehme

[11] Patent Number: 4,624,511

[45] Date of Patent: Nov. 25, 1986

[54] STABILIZER LEG INTERLOCK

[75] Inventor: William J. Oehme, Boca Raton, Fla.

[73] Assignee: Harris Corporation, Melbourne, Fla.

[21] Appl. No.: 747,633

[22] Filed: Jun. 24, 1985

[51] Int. Cl.[4] ..... A47B 81/00

[52] U.S. Cl. ..... 312/273; 312/271; 312/276; 312/216; 312/221

[58] Field of Search ..... 312/276, 273, 271, 221, 312/216

[56] References Cited

U.S. PATENT DOCUMENTS 3,393,950 7/1968 Dutcher et al. ..... 312/276

3,741,620 6/1973 Kull et al. ..... 312/276

3,912,350 10/1975 Gurubatham ..... 312/276

4,240,685 12/1980 Terlecki ..... 312/221

4,441,770 4/1984 Brezosky ..... 312/276

*Primary Examiner*—James T. McCall

*Attorney, Agent, or Firm*—Joel I. Rosenblatt

[57] ABSTRACT

A cabinet has drawers mounted for movement in and out of the cabinet to prevent the cabinet from tipping when one or more of those drawers are displaced outside the cabinet while still attached to the cabinet, a stabilizer leg is provided with an interlock. The interlock prevents the drawer from being removed and tipping the cabinet until the stabilizer leg is in place.

10 Claims, 3 Drawing Figures

STABILIZER LEG INTERLOCK

FIELD OF THE INVENTION

This invention relates to the field of cabinets or racks having spaces for inserting and removing drawers or insertable devices and particularly to a support which may be stowed within the cabinet when not in use and extended from the cabinet base area to prevent the cabinet from tipping when the drawers or devices are withdrawn and extend outside the base of the cabinet.

BACKGROUND OF THE INVENTION

Racks or cabinets are made for the insertion and removal of drawers or other insertable devices which may be insertably mounted in the cabinet. In many cases, such as a file drawer or a rack designed to hold electronic devices, such as computer units, the rack or cabinet is supported on its base area. When the units within the rack are removed and extend over an area outside the base, a force is developed which tends to rotate the cabinet over an edge of the base, toppling the cabinet. This very often happens, for example, when two or more file drawers are pulled out from a cabinet causing a moment or force to be developed about the pivot point formed by an edge of the cabinet and toppling the cabinet.

This toppling force so produced when drawers or other insertably mounted devices are pulled from the cabinet or rack and produce a moment or force extending outside the base, is nullified by the use of a foldable support, which extends outside the base and interacts with an interlock device so the drawers of slideably mounted units cannot be removed to produce the above said toppling force until the support is in place and the toppling effect is thereby prevented.

SUMMARY OF THE INVENTION

A rack or cabinet has positions for inserting and removing drawers or any other insertable device. These devices, by their weight, produce a force when removed from the cabinet. As the cabinet is normally supported over its base area, the force produced by the removed drawers or devices, produce an additional force which is a direction outside the base. As would be understood by those skilled in the art, the result of this force produced by the weight of the drawer or device slid from the cabinet and extending outside the base area of the cabinet, produces a force which tends to make the cabinet or rack unstable, causing it to topple in the direction of the force.

According to the principles of this invention, a stabilizing leg interlock is provided whereby, the drawers or other insertable devices are held in place by a lock, which is not released until a support arm is extended outside the base of the cabinet and connected to the cabinet through the interlock device, thereby supporting the cabinet and releasing the interlock allowing the drawers or insertable devices to be removed in the direction of the support arm.

Accordingly, what is shown is a stabilizing leg having an arm which is foldable against the cabinet and which can be extended outside the base of the cabinet. Additionally shown is a support strut which includes an overcenter joint, which is connected to the arm and mounted for engagement with an interlock device. The support strut produces a force between the interlock device and the arm such that the support strut through the overcenter joint is held in place by that force. The force through the interlock causes a rotation of a locking device which releases the drawer or slideable device, allowing it to be pulled from the rack or cabinet. A return means, such as a spring, rotates the locking mechanism back into engagement with the drawer or insertable device locking the device in place when the support strut is removed from its engaged position with the interlock device, thereby allowing the drawer or insertable device to be locked in place in the rack.

In this way, the base provided for supporting the cabinet, is extended by the stabilizing leg when its stabilizing leg arm is extended outside the base and the support strut connecting the arm to the cabinet is in place. Until such support strut is in place, the interlock means causes the insertable devices or cabinets to be locked into place preventing their release and the unstabilizing force produced on the cabinet.

DESCRIPTION OF THE PREFERRED EMBODIMENT

It should be understood that the principles of the invention, described with reference to a rack used for housing insertably mounted computer equipment, can be extended to any type of cabinet employing any type of drawers or any other type of insertably mounted devices, where such devices, when extended from the cabinet, produce a destabilizing force, directed outside the base area of the cabinet and tending to topple the cabinet.

Figure 1:
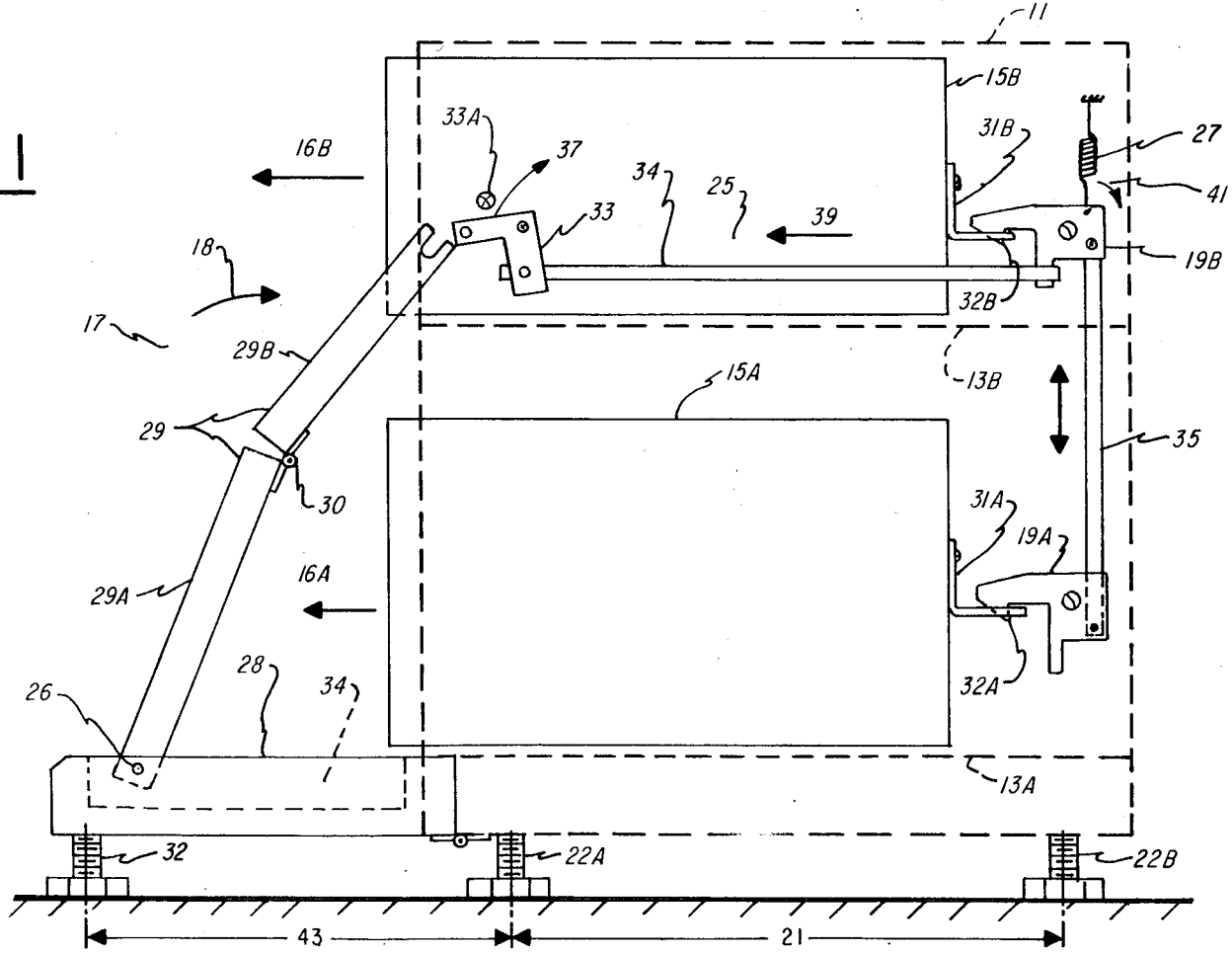
FIG. 1 shows, in partial schematic form, a rack for holding computer peripherals in a locked position and with the stabilizing leg, having its arm fully extended into its operative position and with the support strut in a position ready for engagement with the interlock device.

FIG. 1 shows a rack 11 in dashed lines, having support surfaces or shelves 13*a*, 13*b* for supporting individual insertable devices 15*a*, 15*b* such as computer equipment. It should be understood however, the rack 11 could be any type of cabinet and the receiving means within the cabinet, defined by the support surfaces or shelves 13*a*, 13*b*, could be used for supporting or housing cabinet drawers, other than the computer equipment shown as 15*a* and 15*b*. Included with the rack 11 is a stabilizing leg shown generally as 17, and having an arm 28 and a support strut in two sections 29*a* and 29*b* connected by a pivoting joint shown as 30. In the preferred embodiment, the stabilizing leg arm 28 is shown connected to the cabinet by another pivoting joint 26 so the leg may be stored against the cabinet. The cabinet is supported over a base area 21 defined by the leg supports 22*a*, 22*b*, as would be understood by one skilled in the art. Extension of the stabilizing leg arm 28 provides a third point of support 32, when placed in contact with a support surface and connected to the rack 11 through support strut 29.

Each of the insertable devices 15*a*, 15*b* are held within the rack 11 and their movement out of the cabinet in the direction of arrow 16*a*, 16*b* is prevented by a lock means 19*a*, 19*b* respectively, which includes a hook 32*a*, 32*b* mounted for pivoting movement and for engagement with hook receiving means 31*a*, 31*b* respectively.

In the preferred embodiment, the locking means is joined to the support strut 29 and arm 28 through an interlock device 25 as will be explained. When the interlock device 25 is out of engagement with the support strut 29, as shown in FIG. 1, a return means, shown as spring 27, forces at least one of the locking devices and the respective hook portion thereof 19*b*, 32*b* into engagement with the hook receiving means on its associated insertable device 31*b*. As shown in the preferred embodiment, the locking devices for the other peripherals, such as 19*a* connected to insertable device 15*a*, is slaved to the above mentioned first locking device 19*b* by any suitable connecting means, such as connecting bar 35. Accordingly, any number of slaved locking devices may function in response to the functioning of interlock connected to a master locking device 19*b*. As shown, the locking device 19 is connected through an interlock device 25, to the support strut 17.

The interlocking device 25 includes a interlock connecting bar 34 and a pivoting strut receiving means 33. The strut receiving means 33 is mounted so it may be engaged with the strut when the strut is substantially extended and rotated in the direction of arrow 18 as the strut is placed in its locked position, driving its overcenter joint 30 overcenter. The force then produced when the strut 17 is engaged with the strut receiving means rotates the strut receiving means in the direction of arrow 37 driving the interlock connecting bar 34 in direction of arrow 39 and rotating the locking means 19*b* in the direction of arrow 41.

Referring to FIG. B, the position of the stabilizer leg interlock and the locking means is shown with the strut in its locked position.

As shown, with stabilizer leg arm 28 in its extended position, the support for the cabinet is extended through the combined base area shown as numerals 21 and 43. As stated above, joint 30 for support strut 17 is an overcenter joint such that the force shown in the direction of arrow 49 includes a component, shown as 49*a* and 49*b* driving the joint 30 over the center line of the strut 29 through its longitudinal axis formed as the strut is erected against the interlock device and preventing the strut from being removed from its operative position until a force counteracting forces 49*a* and 49*b* are applied, as is well known in the art.

Figure 2:
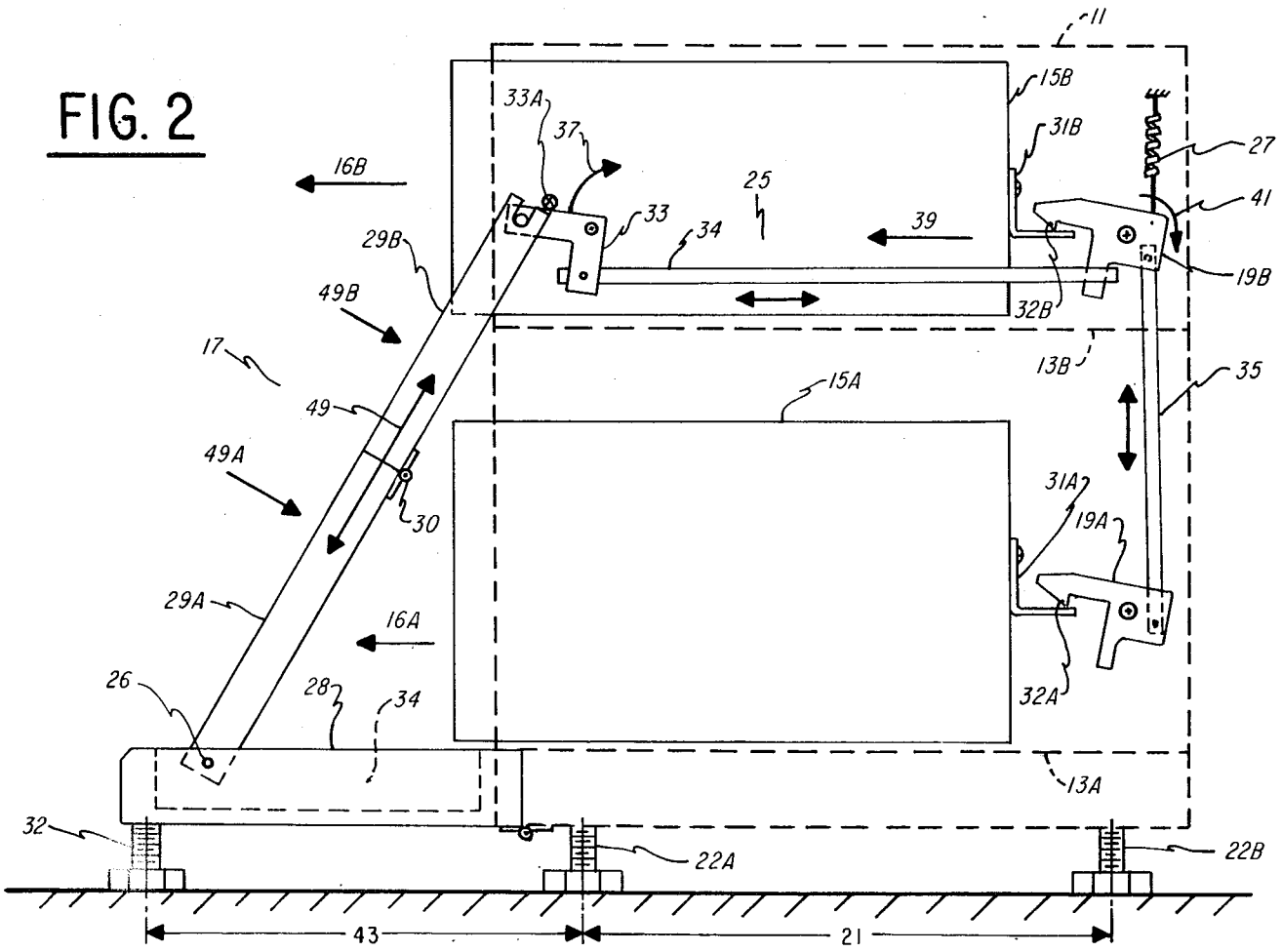
FIG. 2 shows the device of FIG. 1 with the stabilizing leg arm fully extended and the support strut in position co-acting with the interlock device and the insertable devices released from the hooking device and ready to be withdrawn.

As shown in FIG. 2, insertion of the support strut against the strut receiving means 33 causes it to rotate in the direction of arrow 37 driving the connecting bar 34 in direction of arrow 39 and rotating the locking means 19*b* into its unlocked position where its hook 32*b* is disengaged from the respective insertable device hook receiving means 31*b*.

As shown in the preferred embodiment, the other insertable devices may also be engaged through respective locking means and hook receiving means by being slaved thereto through a connecting means, shown as a connecting bar 35.

When the stabilizing leg is in its operative position, and as stated above, the area of support is extended from the area shown by the numeral 21 to the area shown by numeral 43. Removal of the devices in the direction of arrows 16A and 16B, produces a force about a pivot point passing through 22A which is opposed by the support strut 29 acting through the stabilizing leg 28 and its associated support 22*a*.

Figure 3:
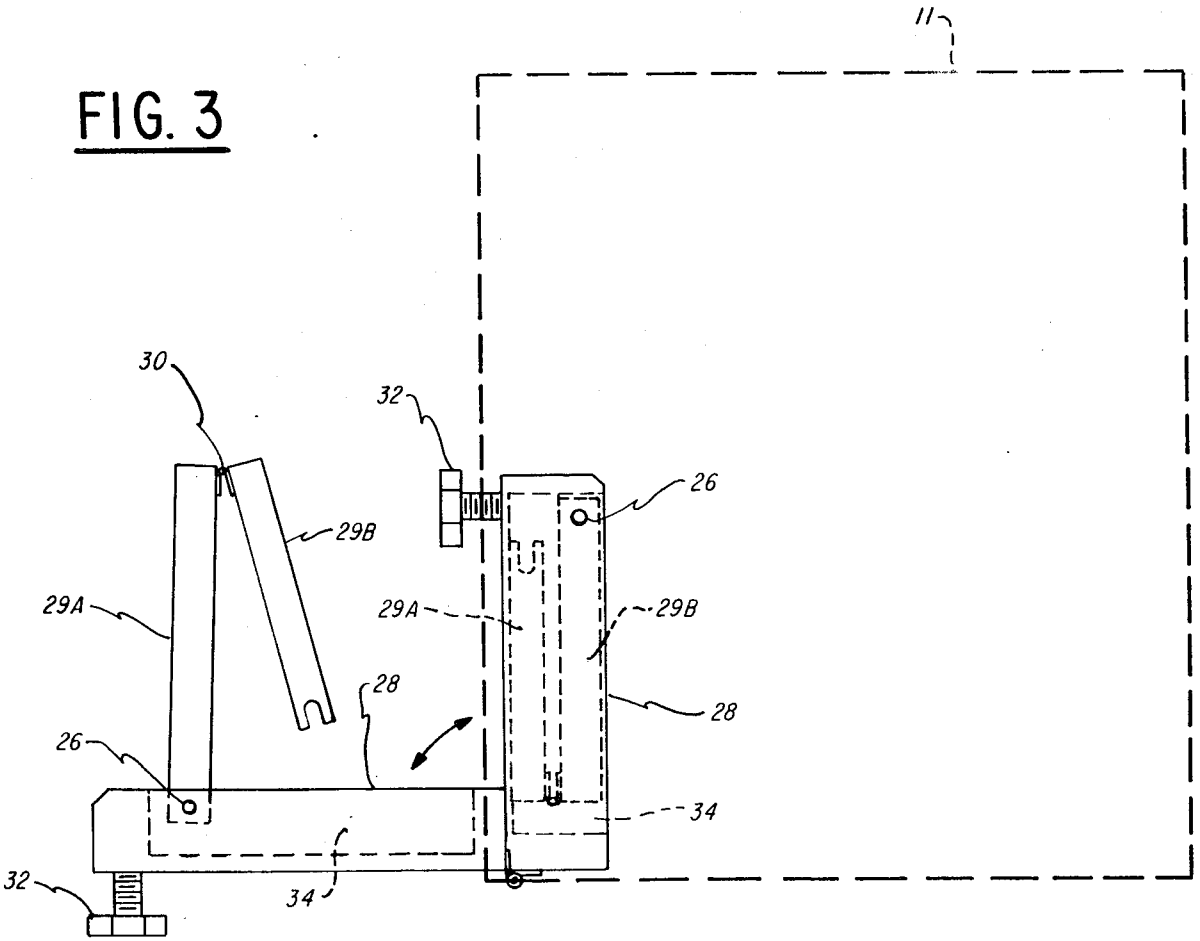
FIG. 3 shows a partial view of stabilizing leg arm in its first extended position from the rack with the support strut in a partially folded position and in a second position, folded for storage against the rack and with the support strut folded within the cavity of the stabilizing leg arm.

FIG. 3 in partial form shows the stabilizing leg 17 with its arm 28 extended and the support strut 29 partially folded, in preparation for storage in the support arm cavity 34 and also shown with the arm in its stored position and the support strut folded for storage in the cavity 34.

It should be understood that the principles of this invention directed to a means for extending the base area for support under a cabinet or rack or similar device and to prevent the removal of insertable devices within the cabinet or rack and the prevention of an unstabilizing force which may topple the cabinet until such stabilizing leg is in place may be applied to any kind of device for holding any type of removable components and which may provide a stabilizing force extending beyond the base of that component.

I claim:

1. Stabilizer leg interlock means for preventing the withdrawal of an insertable device within a cabinet until a cabinet stabilizing leg is placed in an extended and locked support position comprising:

(a) a cabinet having a plurality of receiving means for the insertion and withdrawal of removable devices;

(b) locking means for engagement with one or more of said removable devices and preventing the withdrawal of respective ones of said removable devices;

(c) said cabinet having a base area and being supported on said base;

(d) a cabinet stabilizer leg mounted in said cabinet for extension into an operative position for supporting said cabinet from a first location outside said base;

(e) interlock means for engagement with said cabinet support means and said locking means to disengage said locking means from their respective devices for withdrawal from said cabinet; and (f) said interlock means, when engaged with said stabilizer leg cabinet support in its said operative position, disengaging said locking means.

2. The stabilizer leg interlock means of claim 1, wherein, said locking means includes:

(g) a plurality of locking means with at least the first of said locking means being engaged with said interlock means and at least a second of said locking means being slaved to said first locking means.

3. The stabilizer leg interlock means of claim 2, wherein:

(h) said locking means includes return means for returning said locking means to its engaged position with said device when said interlock means is disengaged from said stabilizer leg support means.

4. The stabilizer leg interlock means of claim 3, wherein:

(i) said devices are mounted for withdrawal in the direction of said first location outside said base to oppose an upsetting force on said cabinet produced when said cabinets are withdrawn and extend outside said base.

5. The stabilizer leg interlock means of claim 4, wherein:

(j) said cabinet stabilizing leg is collapsibly mounted for storage when not extended for use in its said operative position;

(k) said cabinet stabilizer leg including an arm connected to said cabinet at a first end and extendable to a location outside said cabinet base; and (l) a support strut connected to said arm at one end thereof and extendable for engagement with said interlock means, said support strut producing a force to said cabinet from said interlock means for supporting said cabinet against said arm.

6. The stabilizer leg interlock means of claim 5, wherein:

(m) said force is directed along said support strut for maintaining said support strut in its engaged position with said interlock means.

7. The interlock means of claim 6, wherein:

(n) said arm includes a cavity and said support strut is pivotally mounted on said arm for storage in said cavity when disengaged from said interlock means.

8. The stabilizer leg interlock means of claim 7, wherein:

(o) said support strut has a first and second section connected by a pivoting joint, said support strut being rotatable over the center of said pivoting joint when placed in said engaged position with said interlock means; said force along said support strut forcing said support strut in a rotational direction over the center of said pivoting joint for locking said support strut in said engaged position.

9. The stabilizer leg interlock means of claim 1, wherein:

(p) said locking means includes a hook pivotally mounted for insertion into a hook receiving means located on respective insertable devices, said hook producing a force opposing the withdrawal of said device when engaged with said hook receiving means;

(q) said interlock means including an interlock arm which is connected to said support strut when in its lock position and when so engaged forcing said locking means to pivot out of engagement with said hook receiving means and releasing said device for withdrawal.

10. The stabilizer leg interlock means of claim 9, wherein:

(r) said interlock means includes a pivotally mounted strut receiving means, connected to said interlock arm, said strut receiving means being forced into a first position when out of engagement with said strut, responsive to said return means forcing said hook into engagement with said hook receiving means and rotates upon engagement when said strut is engaged and placed in its locked position to drive said interlock arm to rotate said hook out of engagement with said hook receiving means to release said insertable device for withdrawal from said cabinet.

* * * * *